US006632129B2

(12) United States Patent
Goetz

(10) Patent No.: US 6,632,129 B2
(45) Date of Patent: Oct. 14, 2003

(54) FIXED ABRASIVE ARTICLE FOR USE IN MODIFYING A SEMICONDUCTOR WAFER

(75) Inventor: Douglas P. Goetz, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 136 days.

(21) Appl. No.: 09/784,667

(22) Filed: Feb. 15, 2001

(65) Prior Publication Data

US 2002/0111120 A1 Aug. 15, 2002

(51) Int. Cl.[7] ..... B24D 11/00

(52) U.S. Cl. ..... 451/533; 451/527; 451/529; 451/534; 451/550

(58) Field of Search ..... 451/527, 528, 451/529, 530, 533, 534, 537, 539, 548, 550

(56) References Cited

U.S. PATENT DOCUMENTS

| | | | | |
|---|---|---|---|---|
| 4,244,775 | A | | 1/1981 | D'Asaro |
| 4,374,077 | A | | 2/1983 | Kerfeld |
| 4,576,850 | A | | 3/1986 | Martens |
| 4,588,258 | A | | 5/1986 | Hoopman |
| 4,606,154 | A | | 8/1986 | Herrmann et al. |
| 5,020,283 | A | | 6/1991 | Tuttle |
| 5,109,638 | A | | 5/1992 | Kime, Jr. |
| 5,177,908 | A | | 1/1993 | Tuttle |
| 5,183,597 | A | | 2/1993 | Lu |
| 5,212,910 | A | | 5/1993 | Breivogel et al. |
| 5,230,184 | A | | 7/1993 | Bukhman |
| 5,287,663 | A | | 2/1994 | Pierce et al. |
| 5,489,233 | A | | 2/1996 | Cook et al. |
| 5,575,707 | A | | 11/1996 | Talieh et al. |
| 5,607,341 | A | | 3/1997 | Leach |
| 5,609,517 | A | | 3/1997 | Lofaro |
| 5,692,950 | A | | 12/1997 | Rutherford et al. |
| 5,733,178 | A | * | 3/1998 | Ohishi ..... 451/41 |
| 5,897,424 | A | | 4/1999 | Evans et al. |
| 5,897,930 | A | | 4/1999 | Calhoun et al. |
| 5,958,794 | A | | 9/1999 | Bruxvoort et al. |
| 5,975,988 | A | | 11/1999 | Christianson |
| 6,007,407 | A | | 12/1999 | Rutherford et al. |
| 6,022,264 | A | | 2/2000 | Cook et al. |
| 6,059,850 | A | | 5/2000 | Lise et al. |
| 6,206,759 | B1 | * | 3/2001 | Agarwal et al. ..... 451/41 |
| 6,217,426 | B1 | | 4/2001 | Tolles et al. |
| 6,234,875 | B1 | | 5/2001 | Pendergrass, Jr. |

FOREIGN PATENT DOCUMENTS

| | | |
|---|---|---|
| EP | 0 806 267 A1 | 11/1997 |
| EP | 0 919 330 A1 | 6/1999 |
| EP | 0 919 336 A2 | 6/1999 |
| WO | WO 95/22436 | 8/1995 |
| WO | WO 98/06541 | 2/1998 |
| WO | WO 98/49723 | 11/1998 |
| WO | WO 98/50201 | 11/1998 |
| WO | WO 99/10129 | 3/1999 |

OTHER PUBLICATIONS

ASTM D882–88 "Standard Test Method for Tensile Properties of Thin Plastic Sheeting".

ASTM D5024–94 "Standard Test Method for Measuring the Dynamic Mechanical Properties of Plastics in Compressions".

ASTM E345–93 "Standard Test Methods of Tension Testing of Metallic Foil".

ASTM D638–84 "Standard Test Method for Tensile Properties of Plastics".

* cited by examiner

*Primary Examiner*—Timothy V. Eley
(74) *Attorney, Agent, or Firm*—Scott R. Pribnow

(57) ABSTRACT

An abrasive article that includes a fixed abrasive element having a plurality of abrasive particles, a resilient element, and a plurality of rigid segments disposed between the fixed abrasive element and the resilient element.

16 Claims, 4 Drawing Sheets

FIXED ABRASIVE ARTICLE FOR USE IN MODIFYING A SEMICONDUCTOR WAFER

BACKGROUND

The invention relates to modifying the rigid substrate of a fixed abrasive article used in semiconductor wafer modification.

Chemical mechanical planarization (CMP) processes are used in semiconductor wafer fabrication to polish and planarize a semiconductor wafer. CMP processes involve placing an abrasive between a relatively stiff pad and a semiconductor wafer and moving the pad and the semiconductor wafer in relation to each other to modify the surface of the wafer. The abrasive used in a CMP process can be in the form of a slurry, i.e., a liquid medium that includes abrasive particles, or a fixed abrasive element, e.g., an element that includes abrasive particles bonded to a backing.

CMP processes attempt to remove material selectively from relatively higher locations, i.e., features having dimensions on the scale of those features commonly produced by photolithography, to planarize the wafer surface. CMP processes also attempt to remove material uniformly on the scale of the semiconductor wafer so that each die on the wafer is planarized to the same degree in an equivalent period of time. The rate of planarization for each die is preferably uniform over the entire wafer. It is difficult to achieve both of these objectives simultaneously because semiconductor wafers are often warped or curved. Some semiconductor wafers also include numerous step height variations or protrusions, which are produced during the fabrication sequence of an integrated circuit on a wafer. These height variations and the curvature and warp of the semiconductor wafer can interfere with the uniformity of the polishing process such that some regions of the wafer become over polished while other regions remain under polished.

CMP processes that employ a slurry have been modified in an effort to overcome the problem of non-uniform polishing. One such effort employs a composite polishing pad that includes a first layer of elastic material, which is attached to a polishing table, and a second layer of a stiff material covering the elastic layer. The second layer includes an array of tiles separated by channel regions. The channel regions channel slurry across the surface of the polishing pad during the polishing process. Other composite polishing pads include a third layer of a relatively low modulus spongy porous material that transports slurry across the surface of the wafer being polished. During polishing liquid can be transported through the porous material and into the lower layers of the polishing pad.

Fixed abrasive CMP processes do not rely on the transport of loose abrasive particles over the surface of the polishing pad to effect polishing. Instead, such processes use fixed abrasive polishing pads, which include a number of three-dimensional abrasive composites fixed in location on a backing. The three-dimensional abrasive composites include abrasive particles disposed in a binder and bonded to the backing, which forms a relatively high modulus fixed abrasive element. During the CMP process, the wafer surface is polished by contact with the fixed abrasive composites and a substantial majority of the abrasive particles in the abrasive composites remain bonded to the backing.

After a CMP polishing process the semiconductor wafer will have an edge exclusion zone, i.e., a zone at the edge of a polished semiconductor wafer that is not polished sufficiently to provide useful components, e.g., semiconductor components. The portion of the semiconductor wafer that constitutes the edge exclusion zone could be used to make semiconductor devices if it were uniform. Thus, the area of the edge exclusion zone affects the die yield of the wafer.

SUMMARY

In one aspect, the invention features an abrasive article including a) a fixed abrasive element including a plurality of abrasive particles, b) a resilient element, and c) a plurality of rigid segments disposed between the fixed abrasive element and the resilient element.

In some embodiments the rigid segments are attached to one another. In other embodiments the rigid segments are detached from one another. In one embodiment the rigid segments extend from a common substrate and are at least partially defined by a plurality of intersecting grooves in the substrate.

In one embodiment the fixed abrasive element includes a discontinuous layer. In another embodiment the fixed abrasive element includes a plurality of fixed abrasive segments, each fixed abrasive segment being coextensive with one of the rigid segments. In some embodiments the fixed abrasive element extends continuously across a plurality of the rigid segments. In another embodiment the fixed abrasive element is bonded to the rigid segments. In other embodiments the rigid segments are bonded to the resilient element.

In another embodiment the resilient element includes a plurality of resilient segments. In some embodiments the resilient segments are bonded to the rigid segments.

In another embodiment the fixed abrasive element includes a textured, three-dimensional fixed abrasive element. In some embodiments the fixed abrasive element includes a plurality of three-dimensional fixed abrasive composites.

In some embodiments the rigid segments include a top surface, a side wall and a union between the top surface and the sidewall, wherein the union is beveled. In other embodiments the rigid segments include a top surface, a side wall and a union between the top surface and the side wall, wherein the union between the top surface and the sidewall is curved. Another embodiment includes rigid segments that interdigitate with one another.

In other embodiments the rigid segments define a shape selected from the group consisting of a circle, ellipse, triangle, square, rectangle, pentagon, hexagon, heptagon, and octagon. In some embodiments the rigid segments are selected from the group consisting of pyramidal, conical, cylindrical, frusto-conical, frusto-pyramidal and other frusta.

In other embodiments the rigid segments have a cross-sectional area taken in a plane of the segment that is parallel with the abrasive surface of no greater than 400 $mm^2$.

In another aspect, the abrasive article includes a) a fixed abrasive element including i) a backing, ii) a composition disposed on a first major surface of the backing, the composition including a binder and a plurality of abrasive particles, and b) a rigid element bonded to a second major surface of the backing, the rigid element including a plurality of rigid segments.

In other aspects the abrasive article includes a fixed abrasive element including a plurality of abrasive particles, a resilient element and a plurality of rigid elements disposed between the fixed abrasive element and the resilient element, the abrasive article being capable of conforming to the curvature of the surface of a semiconductor wafer and being rigid relative to a die on the surface of a semiconductor wafer.

In one aspect the invention features an apparatus for modifying the surface of a semiconductor wafer, the apparatus including a fixed abrasive element including a plurality of abrasive particles, a resilient element and a plurality of rigid segments disposed between the fixed abrasive element and the resilient element. In one embodiment the fixed abrasive element includes a textured, three-dimensional, fixed abrasive element. In another embodiment the fixed abrasive element includes a three-dimensional fixed abrasive composites. In other embodiments the fixed abrasive element is bonded to the rigid segments. In some embodiments the rigid segments are bonded to the resilient element.

In one embodiment the fixed abrasive element is capable of moving relative to the rigid segments. In another embodiment the fixed abrasive element and the rigid segments are capable of moving relative to the resilient element. In other embodiments the apparatus further includes a first web including the fixed abrasive element, a second web including the plurality of rigid segments, and a third web including the resilient element.

In another embodiment the first web and the second web are movable relative to each other. In other embodiments the second web and the third web are movable relative to each other. In another embodiment the first web and the third web are movable relative to each other. In some embodiments the first web, the second web and the third web are movable relative to each other.

In some embodiments the apparatus further includes a web including a first region including a first plurality of rigid segments having a first cross-sectional area and a second region including a second plurality of rigid segments having a second cross-sectional area, the first cross-sectional area being different from the second cross-sectional area. In one embodiment the rigid layer includes a material selected from the group consisting of metal and plastic.

In other aspects the invention features a method of modifying the surface of a semiconductor wafer, the method including contacting an above-described abrasive article with a semiconductor wafer and moving the semiconductor wafer and the abrasive article relative to each other. In one embodiment the method further includes contacting a first region of the abrasive article with a semiconductor wafer, the first region including a first plurality of rigid segments having a first cross-sectional area, moving the semiconductor wafer and the fixed abrasive article relative to each other, contacting a second region of the abrasive article with the semiconductor wafer, the second region including a second plurality of the rigid segments having a second cross-sectional area and moving the semiconductor wafer and the fixed abrasive article relative to each other. In other embodiments the abrasive article further includes a web, the web including the plurality of rigid segments, the method further including indexing the web from a first position to a second position.

The term "fixed abrasive article" refers to an abrasive article that is substantially free of unattached abrasive particles except as incidentally may be generated during the planarization process.

The term "three-dimensional abrasive article" refers to an abrasive article having numerous abrasive particles extending throughout at least a portion of its thickness such that removing some of the particles during planarization exposes additional abrasive particles capable of performing the planarization function.

The term "textured abrasive article" refers to an abrasive article having raised portions and recessed portions in which at least the raised portions contain abrasive particles and binder.

The term "abrasive composite" refers to a shaped body that includes abrasive particles and a binder.

The invention features an abrasive article that is able to substantially conform to the global topography of the surface of the wafer to be modified while maintaining uniform pressure on the wafer. The abrasive article is particularly well suited to producing semiconductor wafers that exhibit good surface uniformity. The presence of rigid segments in the subpad of the abrasive article provides an abrasive article that exhibits localized rigidity, i.e., the interaction between the abrasive article and the semiconductor wafer is rigid over an area that approximates the area of the rigid segment, which facilitates preferentially removing material from the wafer surface at points that are high relative to their surrounding area, i.e., an area that approximates the area of the rigid segment, while maintaining the global wafer-scale topography on the wafer surface. The abrasive article is also capable of polishing a semiconductor wafer so as to minimize the degree of edge exclusion present on the surface of the wafer, and maximize the useful region of the wafer.

The segmented rigid element, when combined with a fixed abrasive element, provides enhanced wafer uniformity while maintaining good planarization.

The segmented rigid element provides a mechanism for managing the competing requirements of local non-uniform material removal, which is necessary for planarization, and global uniform material removal, which is necessary for uniform processing of each die, including the die at the edge of the wafer.

Other features of the invention will be apparent from the following description of preferred embodiments thereof, and from the claims.

DRAWINGS

Figure 3:
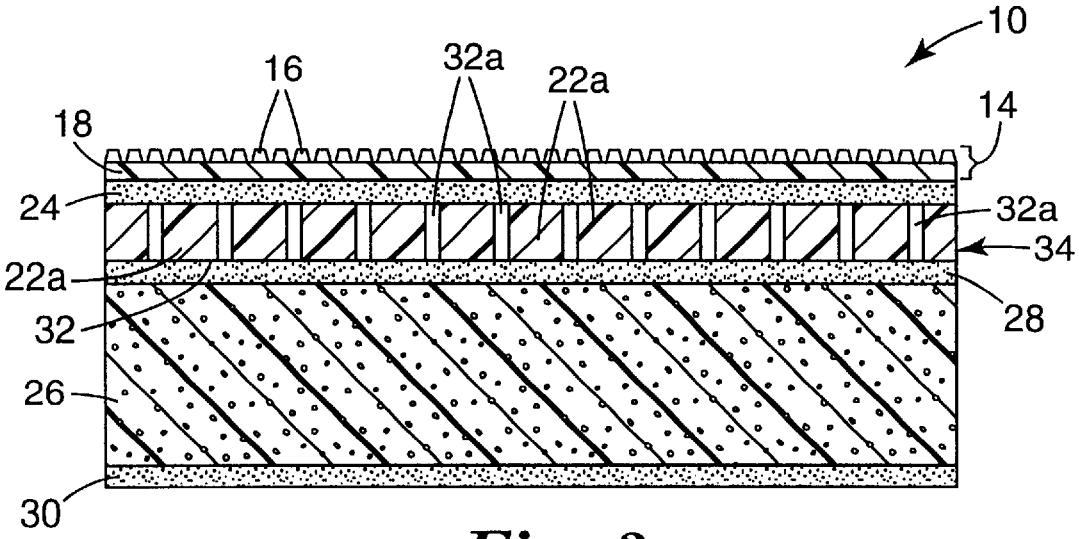
FIG. 3 is a schematic cross sectional view of an abrasive article according to a second embodiment of the invention.
Figure 4A:
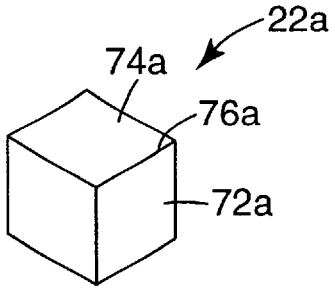
Figure 4B:
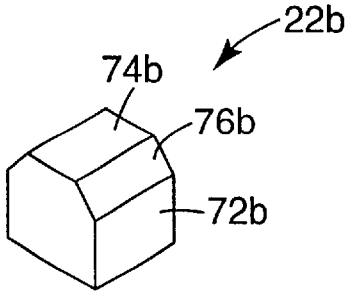
Figure 4C:
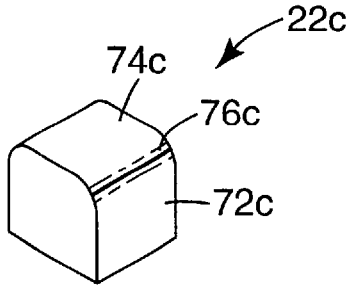

FIGS. 4*a*–4*c* are perspective views of individual rigid segments FIG. 3.

Figure 5:
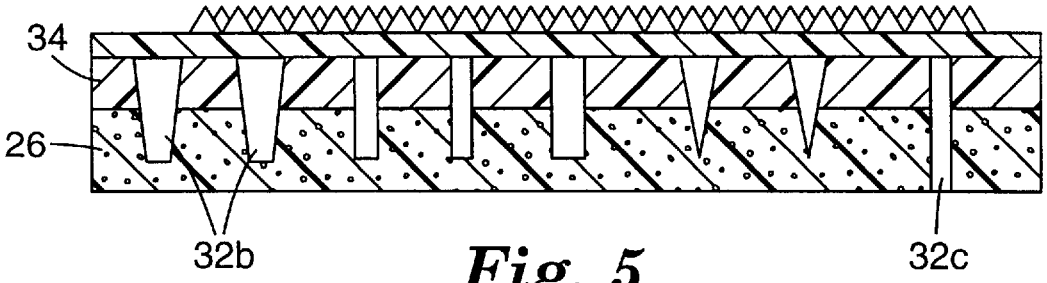

FIG. 5 is a schematic cross sectional view of a portion of an abrasive article according to a third embodiment of the invention.

Figure 6:
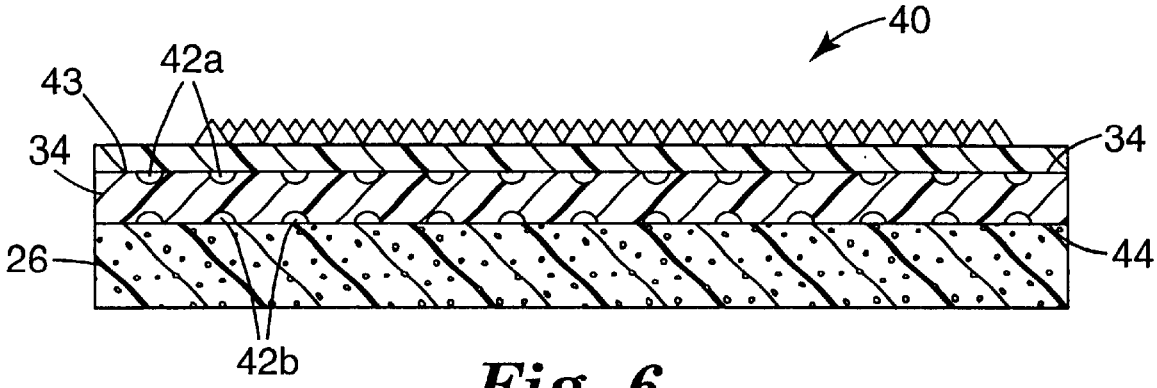

FIG. 6 is a schematic cross sectional view of a portion of an abrasive article according to a fourth embodiment of the invention.

Figure 7:
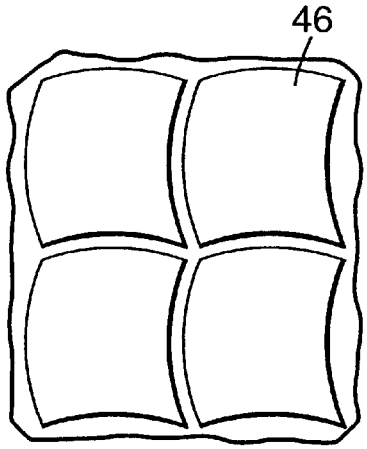

FIG. 7 is a top view of interdigitated rigid segments according to one embodiment of the rigid element.

Figure 8:
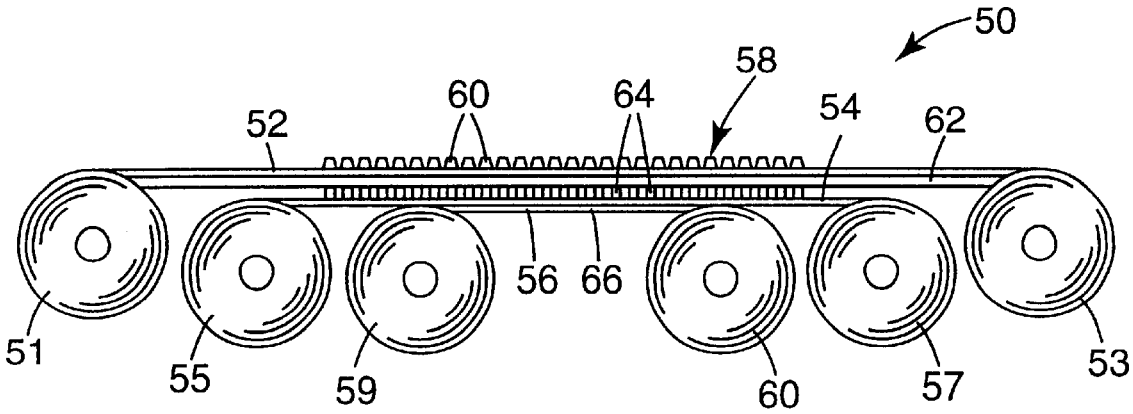

FIG. 8 is a schematic cross sectional view of an apparatus for modifying the surface of a substrate.

Figure 9:
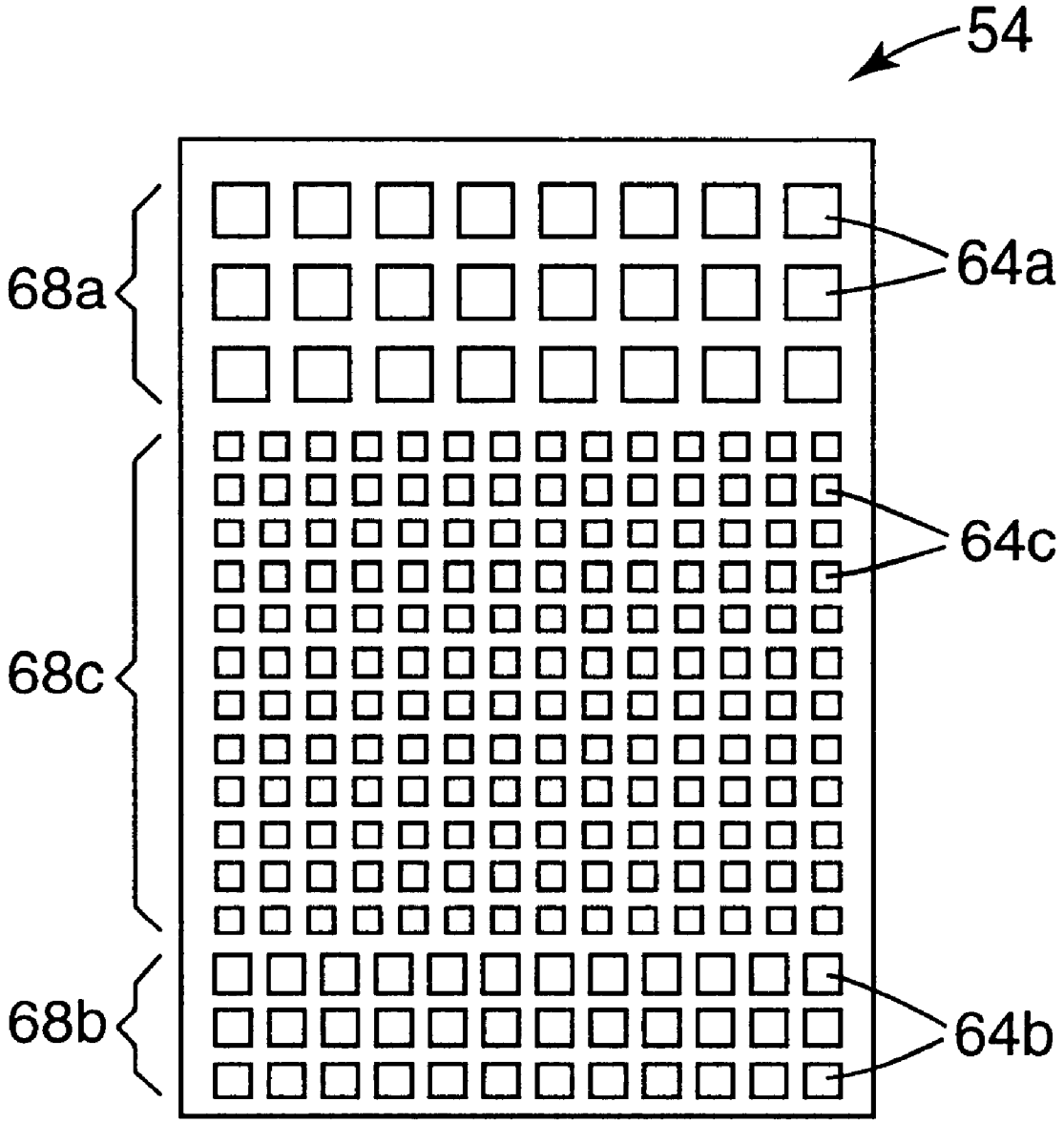

FIG. 9 is a top view of a segmented rigid element.

DETAILED DESCRIPTION OF THE PREFERRED EMBODIMENTS

Figure 1:
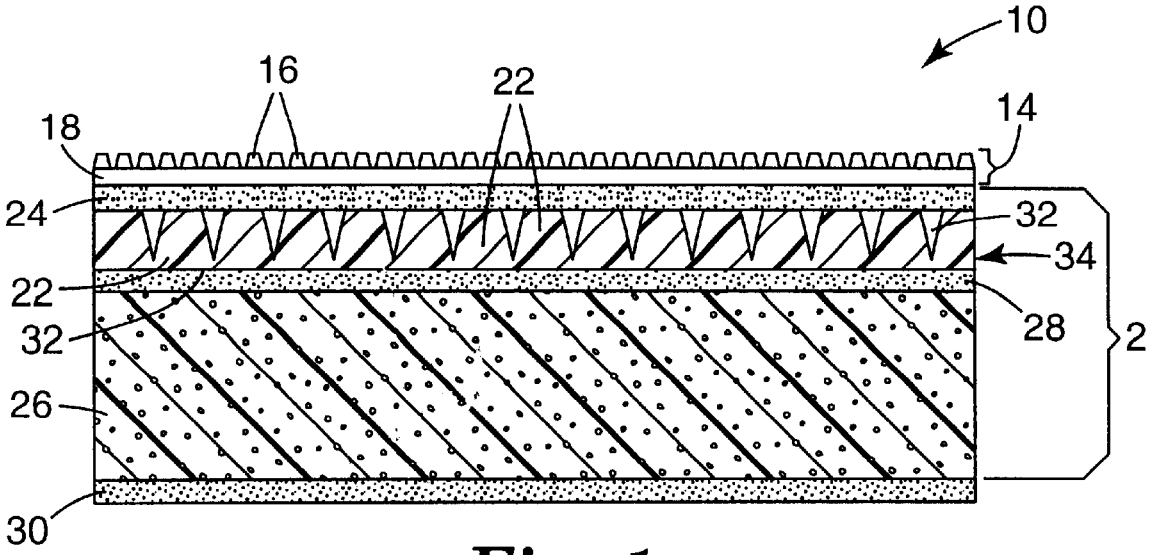
FIG. 1 is a schematic cross sectional view of a portion of an abrasive article of the invention
Figure 2:
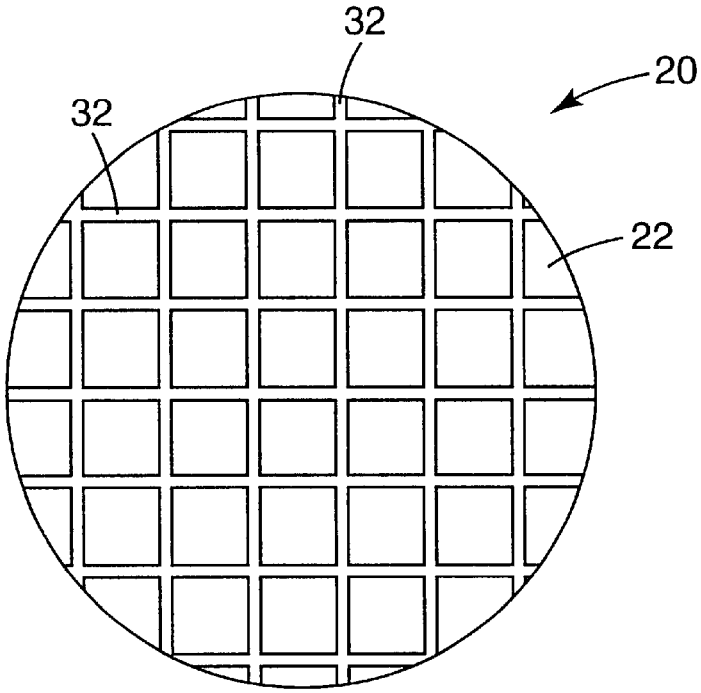
FIG. 2 is a top plan view of the layer of rigid segments of the abrasive article of FIG. 1.

Referring to the Figures, wherein like numerals are used to designate like features throughout and first to FIGS. 1–3, there is shown a fixed abrasive article 10 that includes a fixed abrasive element 14 in the form of a layer disposed on a subpad 2 that includes a relatively more rigid element 34 disposed between the fixed abrasive element 14 and a relatively more resilient element 26. The fixed abrasive element 14 is bonded to the rigid element 34 through an adhesive composition 24. The rigid element 34 is bonded to the resilient element 26 through an adhesive composition 28. The abrasive article 10 further includes a layer of adhesive composition 30 disposed on the bottom surface of the resilient element 26 for use in attaching the abrasive article to a machine platen. The abrasive article 10 is suitable for modifying the surface of a substrate, e.g., the surface of a semiconductor wafer.

The rigid element 34 includes a number of rigid segments 22 spaced apart from each other by grooves 32. The dimension of the rigid segments, the distance the rigid segments are spaced apart from each other and the shape of the rigid segments are selected to achieve a localized rigidity that is suitable for the substrate to be modified.

The dimensions of the rigid segments 22 are selected to optimize localized planarity and global uniformity and to achieve a predetermined edge exclusion zone on a semiconductor wafer being modified by the abrasive article constructed with the rigid element. The size of the rigid segment 22 can be selected based upon the surface characteristics, e.g., die layout, e.g., repeat pattern of the die, and die size relative to the desired edge exclusion zone, of the semiconductor wafer being modified therewith. Preferably the footprint of the rigid segment is no greater than the desired maximum edge exclusion such that the pressure exerted by a rigid segment that does not extend beyond the edge of the semiconductor wafer is not affected by the proximity of the rigid segment to the edge of the semiconductor wafer. The rigid segments 22 are also preferably dimensioned to provide a neighborhood of localized rigidity that approximates or is slightly larger than the footprint of an individual die or repeating lithographic pattern on the semiconductor wafer to be modified. Preferably the rigid segments are from about 0.5 to about 4 times the size of the smallest dimension of the die being polished. Useful rigid segments have a cross-sectional area taken in a plane of the segment that is parallel to the working surface of the abrasive article that is no greater than about 400 $mm^2$.

The rigid segments 22 are separated from one another by grooves 32 extending into the depth of a rigid element 34 and across the surface of the rigid element 34. The grooves 32 render the rigid element 34 relatively more flexible than the rigid element without the grooves such that the rigid element 34 as a whole is capable of conforming to the surface of a semiconductor wafer while the individual segments 22 remain rigid.

The depth to which the grooves 32 extend into the rigid element 34 can vary. The rigid element can include, e.g., grooves 32 that extend into the rigid element 34, through the rigid element 34, through the rigid element 34 and into the underlying relatively more resilient element 26, through the rigid element 34 and through the underlying relatively more resilient element 26, and combinations thereof. As a groove 32 extends farther into the depth of the subpad, the abrasive article construction becomes more flexible. Preferably the grooves extend through the rigid element 34 to provide rigid segments 22 that sit on the resilient element 26 and move substantially independently of the other rigid segments so as to allow the rigid element to conform to the surface of the semiconductor wafer while maintaining localized planarization; more preferably the movement of one rigid segment is not imparted or transferred to any of its neighboring segments.

FIG. 1 illustrates an abrasive article 10 that includes grooves 32 extending into the rigid element 34. FIG. 3 illustrates grooves 32*a* passing through the rigid element 34 such that rigid segments 22*a* are independently suspended on the resilient element 26. FIG. 5 illustrates grooves 32*b* passing through the rigid element 34 and extending into the resilient element 26 and grooves 32*c* passing through the rigid element 34 and through the resilient element 26.

FIG. 6 illustrates an abrasive article 40 that includes grooves 42*a* extending into the rigid element 34 from the top surface 43 of the rigid element 34 and grooves 42*b* extending into the rigid element 34 from the bottom surface 44 of the rigid element 34.

The width of the grooves, i.e., the spacing between segments, is selected based on the desired subpad flexibility and conformity. The width of the groove can be increased such that the segments are completely separated or substantially completely separated from each other. In general, during CMP processes, the nominal pressure at the wafer surface is controlled by imposing pressure on the back side of the wafer. For wider grooves, the fraction of the total plan area occupied by the rigid segments is reduced. Since pressure is transmitted through the rigid segments, the total force exerted on the back side of the wafer is transmitted through a smaller total area relative to an unsegmented rigid element and the nominal pressure at the tops of the rigid segments, where material removal processes occur, is increased. In such circumstances, the nominal pressure exerted on the segments and transferred to the semiconductor wafer can be controlled by changing the percentage of segments, e.g., if 50% of the plan area of the rigid element includes segments, the average pressure at the process surface increases by a factor of 2 over the nominal applied pressure. The effect of groove width on the process pressure is another factor to be considered in choosing groove width.

The shape of the groove is defined by at least one side wall, e.g., a continuous arcuate side wall, and can be defined by two or more side walls including, e.g., two substantially parallel side walls, two diverging or converging side walls, and two side walls separated by the bottom wall of the groove.

The grooves 32 can be arranged to define rigid segments having a variety of shapes including, e.g., circular, elliptical, polygonal, e.g., triangles, rectangles, hexagons, and octagons. The rigid segments can be in a variety of forms including, e.g., parallelepiped, cylindrical, conical, pyramidal, frusto-pyramidal, frusto-conical, frusto-hemispherical, and other frusta. FIG. 2 illustrates an array of grooves positioned at right angles to each other to define generally square rigid segments 22. The rigid segments 22 can also be shaped to interdigitate with one another as illustrated, e.g., in FIG. 7.

FIG. 4*a* illustrates a rigid segment 22*a* in which the union 76*a* of a side wall 72*a* and the top wall 74*a*, i.e., the surface of the rigid segment that is closest to the abrasive element, of a rigid segment 22*a* form a 90° angle. The union 76 of the side walls 72 and the top wall 74 can also be other than a 90° angle including, e.g., a slanted or curved union. FIG. 4*b* illustrates a rigid segment 22*b* in which the union 76*b* between the side wall 72*b* and the top wall 74*b* is tapered, i.e., beveled. FIG. 4*c* illustrates a rigid segment in which the union 76*c* between the side walls 72*c* and the top wall 74*c* is rounded. Tapering or rounding one or more of the corners of the rigid segment at the top of the rigid segment provides for a relatively smoother transition for the semiconductor wafer moving across the surface of an abrasive article constructed therewith.

FIG. 9 illustrates an embodiment in which the rigid element 54 includes a number of rigid segments 64*a*, 64*b* and 64*c* having different dimensions (e.g., cross-sectional area), spacing or shapes, and located in different regions 68*a*, 68*b* and 68*c* on the rigid element.

The rigid element is preferably in the form of a layer that is coextensive with the abrasive element and the abrasive element preferably extends across the rigid segments and the spaces, i.e., the grooves, between the rigid segments. The segmented rigid element can be in a variety of forms including, e.g., a round disk and a continuous web, e.g., a belt.

The material of the segmented rigid element is selected in combination with the material of the resilient element and rigid segment geometry to provide an abrasive construction that exhibits uniform material removal across the surface of the substrate to be modified, and good planarization of lithographically produced features.

Preferred rigid materials have a Young's Modulus value of at least about 100 MPa. The Young's Modulus of the rigid element is determined using the appropriate ASTM test in the plane defined by the two major surfaces of the material at room temperature (20° C. to 25° C.). The Young's Modulus of an organic polymer (e.g. plastics or reinforced plastics) can be determined according to ASTM D638-84 (Standard Test Methods for Tensile Properties of Plastics) and ASTM D882-88 (Standard Tensile Properties of Thin Plastic Sheet). The Young's Modulus of a metal is measured according to ASTM E345-93 (Standard Test Methods of Tension Testing of Metallic Foil). For laminated elements that include multiple layers of materials, the Young's Modulus of the overall element (i.e., the laminate modulus) can be measured using the test for the highest modulus material.

The thickness of the rigid element is selected based upon its modulus and the desired properties of the resulting abrasive construction. Useful thickness values for the rigid element range from about 0.075 mm to about 1.5 mm. Often as the Young's Modulus for a material increases, the required thickness of the material decreases.

The rigid element can be made from a variety of materials including, e.g., organic polymers, inorganic polymers, ceramics, metals, composites of organic polymers, and combinations thereof. Suitable organic polymers can be thermoplastic or thermoset. Suitable thermoplastic materials include, polycarbonates, polyesters, polyurethanes, polystyrenes, polyolefins, polyperfluoroolefins, polyvinyl chlorides, and copolymers thereof. Suitable thermosetting polymers include, e.g., epoxies, polyimides, polyesters, and copolymers thereof (i.e., polymers containing at least two different monomers including, e.g., terpolymers and tetrapolymers).

The polymer of the rigid element may be reinforced. The reinforcement can be in the form of fibers or particulate material. Suitable materials for use as reinforcement include, e.g., organic or inorganic fibers (e.g., continuous or staple), silicates, e.g., mica or talc, silica-based materials, e.g., sand and quartz, metal particulates, glass, metallic oxides and calcium carbonate, or a combination thereof.

Metal sheets can also be used as the rigid element. Suitable metals include, e.g., aluminum, stainless steel and copper.

Particularly useful rigid materials include poly(ethylene terephthalate), polycarbonate, glass fiber reinforced epoxy boards, aluminum, stainless steel and IC 1000 (available from Rodel, Inc., Newark, Del.).

The resilient element 26 can be a continuous layer or a discontinuous layer and can be divided into segments as described above with respect to the segmenting of the rigid substrate as illustrated in FIG. 5. The resilient element can include one layer of material or a number of layers of the same or different materials, provided that the mechanical behavior of the layered element is acceptable for the desired application. The resilient element is preferably capable of undergoing compression during a surface modification process. The resiliency, i.e., the stiffness in compression and elastic rebound, of the resilient element is related to the modulus of the material of the resilient element in the thickness direction and is also affected by the thickness of the resilient element.

The choice of material for the resilient element, as well as the thickness of the resilient element, will vary depending on the variables in the process including, e.g., the composition of the workpiece surface and fixed abrasive element, the shape and initial flatness of the workpiece surface, the type of apparatus used for modifying the surface (e.g. planarizing the surface), and the pressures used in the modification process.

Preferred resilient materials including, e.g., the overall resilient element itself, have a Young's Modulus value of less than about 100 MPa, more preferably less than about 50 MPa. Dynamic compressive testing of resilient materials can be used to measure the Young's Modulus (often referred to as the storage or elastic modulus) in the thickness direction of the resilient material. ASTM D5024-94 (Standard Test Methods for Measuring the Dynamic Mechanical Properties of Plastics in Compression) is a useful method for measuring the Young's Modulus of resilient material, whether the resilient element is one layer or a laminated element that includes multiple layers of materials. The Young's Modulus of the resilient element is determined according to ASTM D5024-94 in the thickness direction of the material at 20° C. and 0.1 Hz with a preload equal to the nominal CMP process pressure.

Suitable resilient materials can also be selected by additionally evaluating their stress relaxation. Stress relaxation is evaluated by deforming a material and holding it in the deformed state while the force or stress needed to maintain deformation is measured. Suitable resilient materials (or the overall resilient element) preferably retain at least about 60% (more preferably at least about 70%) of the initially applied stress, after 120 seconds. This is referred to herein, as the "remaining stress" and is determined by first compressing a sample of material no less than 0.5 mm thick at a rate of 25.4 mm/minute until an initial stress of 83 kPa is achieved at room temperature (20° C.–25° C.) and measuring the remaining stress after 2 minutes.

The resilient element can include a wide variety of resilient materials. Examples of useful resilient materials include organic polymers, e.g., thermoplastic or thermoset polymers, that may be elastomeric. Suitable organic polymers include those organic polymers that are foamed or blown to produce porous organic structures, i.e., foams. Such foams may be prepared from natural or synthetic rubber or other thermoplastic elastomers, e.g., polyolefins, polyesters, polyamides, polyurethanes, and copolymers thereof. Suitable synthetic thermoplastic elastomers include, e.g., chloroprene rubbers, ethylene/propylene rubbers, butyl rubbers, polybutadienes, polyisoprenes, EPDM polymer, polyvinyl chlorides, polychloroprenes, styrene-butadiene copolymers, and styrene-isoprene copolymers, and mixtures thereof. One example of a useful resilient material is a copolymer of polyethylene and ethylvinyl acetate in the form of foam.

Other useful resilient materials include polyurethane impregnated felt-based materials, nonwoven or woven fiber mats that include, e.g., polyolefin, polyester or polyamide fibers, and resin impregnated woven and nonwoven materials. The fibers may be of finite length (i.e., staple) or substantially continuous in the fiber mat.

Examples of useful commercially available resilient materials include poly(ethylene-co-vinyl acetate) foams available under the trade designations 3M SCOTCH brand CUSHIONMOUNT Plate Mounting Tape 949 double-coated high density elastomeric foam tape (Minnesota Mining and Manufacturing Company, St. Paul, Minn.), EO EVA foam (Voltek, Lawrence, Mass.), EMR 1025 polyethylene foam (Sentinel Products, Hyannis, N.J.), HD200 polyurethane foam (Illbruck, Inc. Minneapolis, Minn.), MC8000 and MC8000EVA foams (Sentinel Products), SUBA IV Impregnated Nonwoven (Rodel, Inc., Newark, Del.).

Commercially available pads having rigid and resilient elements that are used in slurry polishing operations are also suitable. An example of such a pad is available under the trade designation IC1000-SUBA IV from Rodel, Inc. (Newark, Del.).

The abrasive element 14 of FIGS. 1 and 3 includes a plurality of abrasive particles in fixed position in a binder, optionally bonded to a support 18, e.g., a backing. Preferably the abrasive element is a textured, three-dimensional, fixed abrasive element that includes a number of composites 16 of abrasive particles disposed in a binder and bonded to a backing 18. The abrasive composites 16 of the textured, three-dimensional, fixed abrasive element can be arranged in a pattern, randomly and combinations thereof. Examples of useful textured, three-dimensional, fixed abrasive elements are disclosed in U.S. Pat. No. 5,958,794 (Bruxvoort et al.) and WO 98/49723 (Kaisaki) published Nov. 5, 1998, and incorporated herein.

The fixed abrasive element with its abrasive particles disposed in a binder has a relatively high modulus. The backing of the fixed abrasive element may have high in plane modulus, yet be sufficiently thin to be flexible. The in plane stiffness and flexibility of the fixed abrasive element is preferably sufficient to enable the fixed abrasive element to be used in the form of a web including, e.g., being capable of being wound in a roll on take up and unwind rollers.

The abrasive element can be in the form of a layer extending across the rigid segments. The abrasive element can also be coextensive with individual rigid segments.

Useful abrasive article constructions include, e.g., disc, web and multiple web constructions. The components of the abrasive article can be maintained in fixed relation to each other. Examples of useful means for maintaining the various components of the abrasive article in fixed relation to each another include, e.g., adhesive compositions, mechanical fastening devices, tie layers, and combinations thereof. The components can also be bonded together through processes including, e.g., thermal bonding, ultrasonic welding, microwave-activated bonding, coextrusion of at least two components of the abrasive article, and combinations thereof.

Useful adhesives include, e.g., pressure sensitive adhesives, hot melt adhesives and glue. Suitable pressure sensitive adhesives include a wide variety of pressure sensitive adhesives including, e.g., natural rubber-based adhesives, (meth)acrylate polymers and copolymers, AB or ABA block copolymers of thermoplastic rubbers, e.g., styrene/butadiene or styrene/isoprene block copolymers available under the trade designation KRATON (Shell Chemical Co., Houston, Tex.) or polyolefins. Suitable hot melt adhesives include, e.g., polyester, ethylene vinyl acetate (EVA), polyamides, epoxies, and combinations thereof. The adhesive preferably has sufficient cohesive strength and peel resistance to maintain the components of the fixed abrasive article in fixed relation to each other during use and is resistant to chemical degradation under conditions of use.

The abrasive article can also include a variety of mechanisms for attachment to a machine platen, e.g., a machine platen used in chemical mechanical planarization, including, e.g., adhesive or mechanical means including, e.g., placement pins, retaining ring, tension, vacuum or a combination thereof.

The abrasive article can be adapted for use in many types of semiconductor wafer planarizing machines including those suitable for use with polishing pads and loose abrasive slurries. An example of a suitable commercially available machine is a Chemical Mechanical Planarization (CMP) machine available from Applied Materials, Inc. (Santa Clara, Calif.).

At least one component of the abrasive article including, e.g., the resilient element, the abrasive element, the rigid element or a combination thereof, can also be moveable relative to another component either during or before and after wafer surface modification. This arrangement may be desirable for a variety of purposes including, e.g., introducing a fresh fixed abrasive surface and maintaining stable web properties (including, e.g., the level of resiliency of the resilient element and the abrasive nature of the abrasive element) from wafer to wafer.

FIG. 8 illustrates an apparatus 50 for modifying a substrate that includes a number of webs 52, 54, 56 where each web extends between an unwind roller 51, 55, and 59, respectively, and a take-up roller 53, 57 and 60, respectively. Web 52 includes an abrasive element 58 of fixed abrasive composites 60 bonded to a backing 62. Web 54 includes a number of rigid segments 64. Web 54 is capable of being rolled up due to the reduced flexural rigidity of the rigid element that results from segmenting the rigid element. Web 56 includes a resilient element 66. The individual webs 52, 54, 56 can move independently of one another, e.g., the abrasive web 52 is capable of moving independently of the segmented rigid web 54 and the resilient web 56. Individual webs 52, 54, 56 can also move at the same speed or different speeds and at least one web can remain stationary while another web moves. Alternatively, at least two of the webs 52, 54, 56 can be in a fixed relationship to each other, e.g., bonded together, and capable of moving as a single unit. The individual webs can be held stationary using mechanisms that include, e.g., exerting tension using the wind and unwind rollers, applying forces at the edges of the webs by a variety of mechanisms including, e.g., vacuum hold-down to the machine platen, and combinations thereof.

The individual webs 52, 54, 56 can also move independently of or simultaneously with one another to provide an abrasive article that includes one or more regions exhibiting different properties to achieve an abrasive article having desired surface modifying properties. The segmented rigid element 54 illustrated in FIG. 9, for example, when incorporated into a web-based abrasive article construction creates regions of different surface modifying characteristics in the abrasive article, which correspond to the different regions on the segmented rigid web. In addition or alternatively, the apparatus 50 may include an abrasive web 58 that includes regions in which the textured, fixed abrasive composites 60 have a more aggressive abrading property, and regions in which the textured, fixed abrasive composites 60 have a less aggressive abrading property, which may result from, e.g., the abrasive web fabrication process or use in a previous polishing operation. The mechanism that controls the movement of the semiconductor wafer relative to the abrasive article can be preprogrammed such that the wafer contacts the various regions of the abrasive article according to a predetermined surface modifying sequence to achieve a desired surface modification.

The abrasive article and apparatus can be used in a variety of semiconductor wafer surface modifying processes including those methods described in, e.g., U.S. Pat. Nos. 5,958,794 (Bruxvoort et al.) and 6,007,407 and incorporated herein.

Other embodiments are within the claims.

What is claimed is:

1. An abrasive article comprising:

a) a fixed abrasive element comprising a plurality of abrasive particles;

b) a resilient element; and c) a plurality of rigid segments disposed between said fixed abrasive element and said resilient element, wherein said rigid segments are attached to one another.

2. An abrasive article comprising:

a) a fixed abrasive element comprising a plurality of abrasive particles;

b) a resilient element; and c) a plurality of rigid segments disposed between said fixed abrasive element and said resilient element, wherein said rigid segments extend from a common substrate and are at least partially defined by a plurality of intersecting grooves in said substrate.

3. An abrasive article comprising:

a) a fixed abrasive element comprising a plurality of abrasive particles;

b) a resilient element; and c) a plurality of rigid segments disposed between said fixed abrasive element and said resilient element, wherein said fixed abrasive element extends continuously across a plurality of said rigid segments.

4. An abrasive article comprising:

a) a fixed abrasive element comprising a plurality of abrasive particles;

b) a resilient element; and c) a plurality of rigid segments disposed between said fixed abrasive element and said resilient element, wherein said rigid segments comprise a top surface, a side wall and a union disposed between the top surface and the side wall, said union being beveled.

5. An abrasive article comprising:

a) a fixed abrasive element comprising a plurality of abrasive particles;

b) a resilient element; and c) a plurality of rigid segments disposed between said fixed abrasive element and said resilient element, wherein said rigid segments comprise a top surface, a side wall, and a union disposed between the top surface and side wall, said union being curved.

6. An abrasive article comprising:

a) a fixed abrasive element comprising a plurality of abrasive particles;

b) a resilient element; and c) a plurality of rigid segments disposed between said fixed abrasive element and said resilient element, wherein said rigid segments are interdigitating.

7. An abrasive article comprising:

a) a fixed abrasive element comprising a plurality of abrasive particles;

b) a resilient element; and c) a plurality of rigid segments disposed between said fixed abrasive element and said resilient element, wherein said rigid segments are selected from the group consisting of pyramidal, conical, cylindrical, frusto-conical, frusto-pyramidal, frusto-hemispherical, and other frusta.

8. An abrasive article comprising:

a) a fixed abrasive element comprising i) a backing;

ii) a composition disposed on a first major surface of said backing, said composition comprising a binder and a plurality of abrasive particles; and b) a rigid element bonded to a second major surface of said backing, said rigid element comprising a plurality of rigid segments.

9. The article of claim 8, wherein said rigid segments are attached to one another.

10. The article of claim 8, wherein said rigid segments extend from a common substrate and are at least partially defined by a plurality of intersecting grooves in said substrate.

11. The article of claim 8, wherein said rigid segments are detached from one another.

12. The article of claim 8, wherein said fixed abrasive element comprises a discontinuous layer.

13. The article of claim 8, wherein said fixed abrasive element comprises a plurality of fixed abrasive segments, each fixed abrasive segment being coextensive with one of said rigid segments.

14. The article of claim 8, wherein said fixed abrasive element extends continuously across a plurality of said rigid segments.

15. The article of claim 8, wherein said fixed abrasive element comprises a textured, three-dimensional fixed abrasive element.

16. The article of claim 8, wherein said fixed abrasive element comprises a plurality of three-dimensional fixed abrasive composites.

* * * * *